US005823108A

United States Patent [19]

Kelm

[11] Patent Number: 5,823,108

[45] Date of Patent: Oct. 20, 1998

[54] DEVICE FOR STABILIZING THE TEMPERATURE OF A DUCT ROLLER IN AN INKING UNIT OF A PRINTING PRESS

[75] Inventor: Carsten Kelm, Mannheim, Germany

[73] Assignee: Heidelberger Druckmaschinen AG, Heidelberg, Germany

[21] Appl. No.: 591,962

[22] Filed: Jan. 29, 1996

[30] Foreign Application Priority Data

Jan. 27, 1995 [DE] Germany ..... 195 02 475.3

[51] Int. Cl.[6] ..... B41F 31/26

[52] U.S. Cl. ..... 101/348

[58] Field of Search ..... 101/350, 363, 101/364, 148, 207–210, 348, 487, 488; 165/89, 90

[56] References Cited

U.S. PATENT DOCUMENTS

| | | | |
|---|---|---|---|
| 1,850,878 | 3/1932 | Hunt | 101/216 X |
| 2,971,460 | 2/1961 | Shindle | 101/416 |
| 3,583,687 | 6/1971 | Nakahara | 101/216 X |
| 3,704,669 | 12/1972 | Christoff | 101/349 |
| 3,741,115 | 6/1973 | Keller . | |
| 4,183,298 | 1/1980 | Cappel et al. | 101/348 |
| 4,534,289 | 8/1985 | Dürrnagel et al. . | |
| 4,712,475 | 12/1987 | Kemmerer et al. . | |
| 5,174,206 | 12/1992 | Molinatto . | |
| 5,189,960 | 3/1993 | Valentini et al. . | |
| 5,272,971 | 12/1993 | Fredericks . | |

FOREIGN PATENT DOCUMENTS

| | | |
|---|---|---|
| 1 584 160 | 12/1969 | France . |
| 1035353 | 7/1958 | Germany . |
| 26 58 380 | 7/1978 | Germany . |
| 4-39446 | 2/1992 | Japan . |
| 642973 | 9/1950 | United Kingdom . |
| 1 242 095 | 8/1971 | United Kingdom . |

*Primary Examiner*—J. Reed Fisher
*Attorney, Agent, or Firm*—Herbert L. Lerner; Laurence A. Greenberg

[57] ABSTRACT

Method of stabilizing the temperature of a duct roller in an inking unit of a printing press, the duct roller being formed with an interior space through which a temperature-controlled fluid flows, includes feeding oil from an oil circulation system of the printing press through the interior space of the duct roller and back to the oil circulation system for stabilizing the temperature of the duct roller; and device for performing the method.

4 Claims, 2 Drawing Sheets

DEVICE FOR STABILIZING THE TEMPERATURE OF A DUCT ROLLER IN AN INKING UNIT OF A PRINTING PRESS

BACKGROUND OF THE INVENTION

FIELD OF THE INVENTION

The invention relates to a method and a device for stabilizing the temperature of a duct roller in an inking unit of a printing press and, more particularly, in an inking unit of a sheet-fed rotary offset printing press having a temperature-controlled fluid flowing through an interior space of the duct roller.

In a printing press, the stability of a production run and the avoidance of waste sheets depend, among other factors, also upon the consistency of the ink metering in the ink duct of the inking unit of the printing press. In this regard, stable conditions must prevail in the metering gap formed between ink duct and duct roller. The thickness of the ink layer on the duct roller depends not only upon the setting of the metering gap but also to the greatest extent upon the viscosity of the ink. For an ink viscosity to remain constantly uniform, ink temperature must also be constantly uniform. Only little heat is exchanged by convection and thermal conduction via the surfaces of the ink duct and the duct roller. The temperature of the ink reaches a constant value only very slowly and at a relatively high level.

Printing stops are detrimental to this very delicate or sensitive field or range of print quality.

SUMMARY OF THE INVENTION

It is accordingly an object of the invention to provide a method and device for stabilizing the temperature of an ink roller in an inking unit of a printing press which offer a simple and economical way to stabilize the temperature at a constant level, notwithstanding any possible printing stop or interruption.

With the foregoing and other objects in view, there is provided, in accordance with one aspect of the invention, a method of stabilizing the temperature of a duct roller in an inking unit of a printing press, the duct roller being formed with an interior space through which a temperature-controlled fluid flows, which comprises feeding oil from an oil circulation system of the printing press through the interior space of the duct roller and back to the oil circulation system for stabilizing the temperature of the duct roller.

In accordance with another mode, the method according to the invention includes introducing the oil from the oil circulation system of the printing press at one end of the duct roller into the interior space thereof, and discharging the oil from the interior space at an opposite end of the duct roller, so that the oil flows through the interior space.

In accordance with another aspect of the invention, there is provided a device for stabilizing the temperature of a duct roller in an inking unit of a printing press having an oil circulation system, the duct roller being formed with an interior space through which a temperature-controlled fluid flows, comprising a respective inlet and outlet for the fluid connected to respective lines of the oil circulation system of the printing press so as to integrate the interior space of the duct roller with the oil circulation system of the printing press.

In accordance with a further aspect of the invention, there is provided a device for stabilizing the temperature of a duct roller in an inking unit of a printing press, the duct roller having an interior space through which a temperature-controlled fluid flows, comprising an ink flow inlet and an ink flow outlet for the fluid, the ink flow inlet being fixedly mounted at one end of the duct roller and including a pipe stub extending almost entirely through a bore, which is formed in the one end of the duct roller and has a diameter greater than the outer diameter of the pipe stub, and the interior space of the duct roller.

In accordance with another feature of the invention, the printing press has an oil circulation system including an oil feed line, and the bore formed in the one end of the duct roller is axially disposed therein, and one end of the pipe stub is fixedly supported in a frame of the printing press and connected to the oil feed line, and another end of the pipe stub passes in a cantilevered manner through the axial bore formed in the one end of the duct roller in a spaced and non-contacting relationship with defining surfaces of the bore and extends into the interior space of the duct roller.

In accordance with an additional feature of the invention, the fixedly supported end of the pipe stub is mounted on a stationary bearing member of a bearing of the duct roller.

In accordance with a concomitant feature of the invention, the device includes an oil reservoir connected to the oil circulation system, oil from the oil circulation system being dischargeable from the interior space of the duct roller through the axial bore of the duct roller into the oil reservoir.

With the method according to the invention, it is possible to transfer the temperature of the lubricating-oil circulation system to the duct roller quite easily and to maintain the temperature of the duct roller at a constant value. The fact that the temperature of the lubricating oil effects an optimized viscosity of the ink available in the ink gap is advantageous. The absolute temperature of the duct roller and the temperature in the metering gap or nip are of relatively minor significance, whereas the constancy of the temperature is of utmost importance. A constant temperature is decisive for the availability of a uniform viscosity of the ink in the metering gap which is adjusted in accordance with the viscosity. Stabilization of the temperature of the duct roller may be performed independently of a possibly existing stabilization of the temperature of the inking unit, a fact which offers a particular advantage of the method according to the invention.

In a further mode of the method according to the invention, the oil is introduced, preferably at one end of the duct roller, from the oil circulation system of the printing press into the interior space of the duct roller and discharged at the opposite end thereof, the oil flowing through the interior space. This ensures the presence of largely constant temperatures over the width of the duct roller. The inflowing oil effects an after-stabilization or regulation of the temperature of the outflowing oil.

For the purpose of stabilizing the temperature of the duct roller, the interior space is integrated into the lubricating-oil circulation system of the printing press, in accordance with a particular aspect of the method, so that lubricating oil of the printing press flows continuously through the interior space of the duct roller, after having been stabilized at a constant level, and thus stabilizes the temperature of the interior space at a constant level corresponding to the temperature of the lubricating oil.

The device according to the invention meets the demands or requirements made thereon, has a a relatively simple construction and operates maintenance-free, in particular, because it does not have any bearings. The inflow of the oil into the interior space of the duct roller and the outflow of the oil therefrom, respectively, is contact-free.

In accordance with an aspect of the invention, the device provides for oil from the oil circulation system to flow through the interior space of the duct roller without contacting any press parts during the inflow; moreover, the device ensures that the temperature remains constant over the entire width of the duct roller because the inflowing oil after-stabilizes or regulates the temperature of the oil flowing out of the duct roller.

Other features which are considered as characteristic for the invention are set forth in the appended claims.

Although the invention is illustrated and described herein as a method and a device for stabilizing the temperature of a duct roller in an inking unit of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
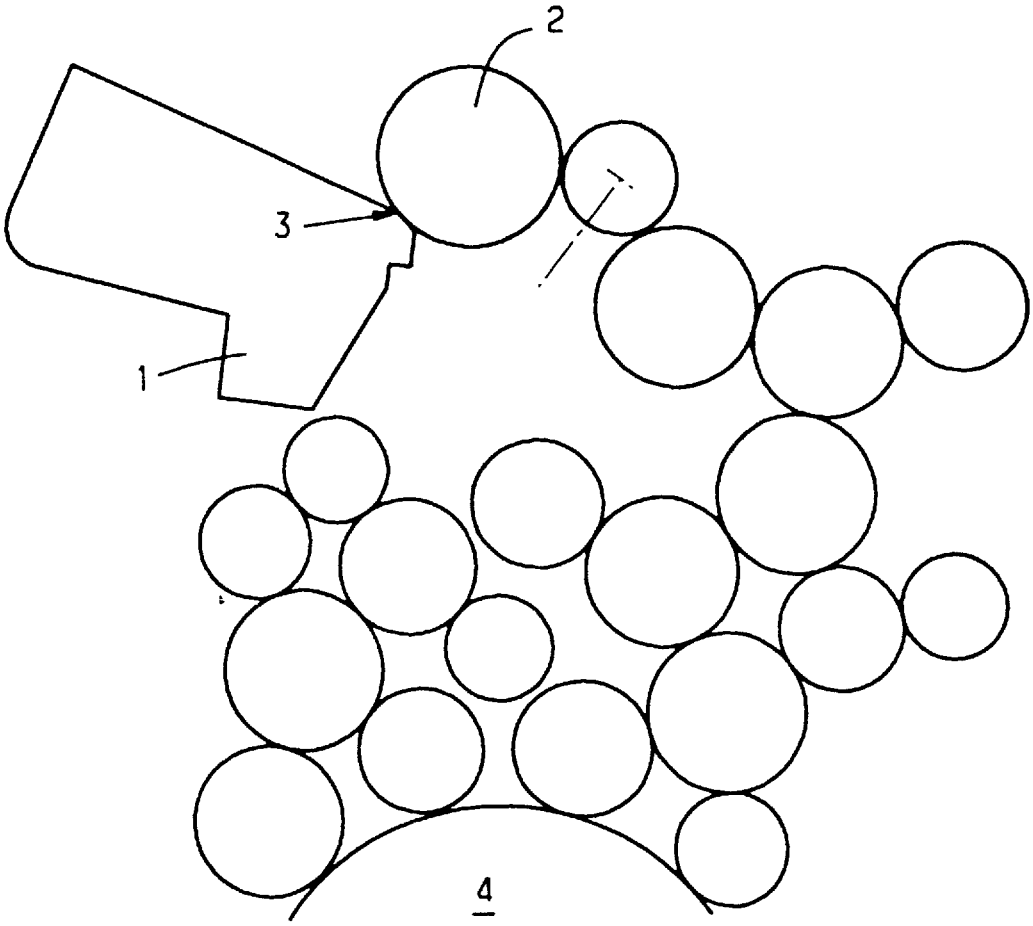
FIG. 1 is a highly diagrammatic side elevational view of an inking unit of a sheet-fed rotary offset printing printing press.
Figure 2:
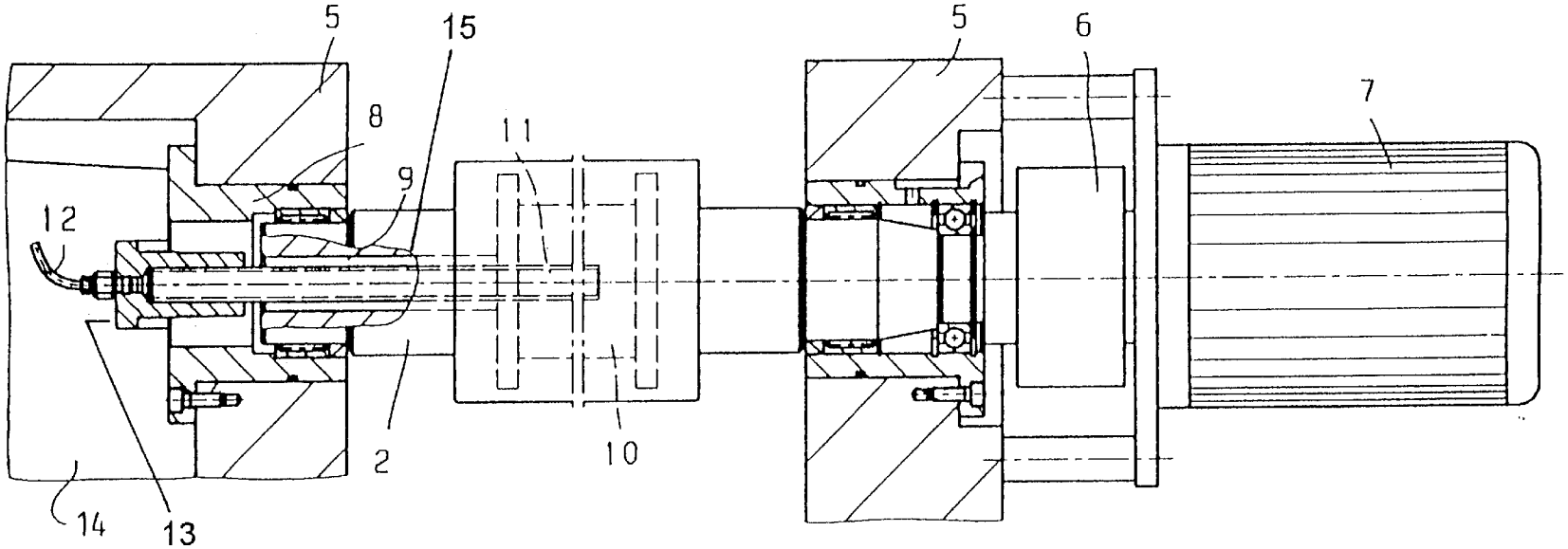
FIG. 2 is a plan view of a duct roller of the inking unit having bearings which are shown in a sectional view taken through an axial plane.
Figure 3:
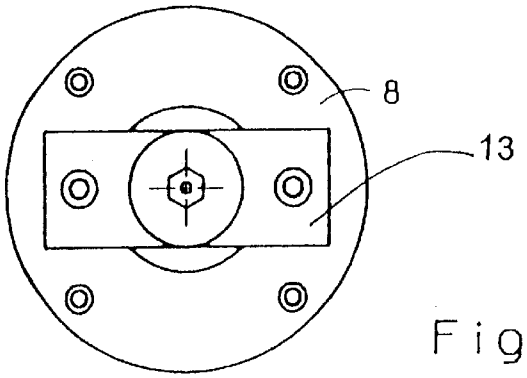
FIG. 3 is an end elevational view of the duct roller of FIG. 2 showing unions for a temperature-controlled fluid provided therein.

Referring now to the drawings and, first, particularly to FIG. 1 thereof, there is shown therein an ink duct 1 and a duct roller 2 having an adjustable metering gap or nip 3 therebetween. An assembly of distributor rollers transfer an ink film from the duct roller 2 onto a plate cylinder 4, for example. As shown in FIG. 2, respective ends of the duct roller 2 are rotatably supported or journalled in a press frame 5 on both sides of a printing press. One journal end of the duct roller 2 is connected to a drive motor 7 by means of a clutch 6, whereas the other end of the duct roller 2 engages in a sleeve-shaped bearing member 8 which, in turn, is disposed firmly in the frame 5. The latter end of the duct roller 2 is formed with an axial bore 9 which is open at a front face of the duct roller 2 and extends into an interior space 10 provided in a region of the duct roller 2 which is effective for ink metering. The shape of the interior space 10 is defined by the dotted lines shown in FIG. 2. At the front-face end of the duct roller 2, an end of a pipe stub 11 is fixedly supported so that the other end thereof extends through the bore 9 without contacting the defining surfaces thereof and projects into the interior space 10. The end of the pipe stub 11 at the front face of the duct roller 2, which is fixedly braced, for example, on the bearing body 8 by means of a holder 13, as shown in FIG. 3, is connected by a line 12 to the lubricating-oil circulation system of the printing press. The other end of the pipe stub 11 extending deeply into the interior space 10 of the duct roller 2 without contacting the surfaces of the duct roller 2 defining the interior space 10 is open, and the pipe stub 11 is surrounded by a narrow annular gap 15 through which oil flowing through the pipe stub 11 is discharged again from the interior space 10. The path of the oil flow is further depicted by the arrows shown in FIG. 2. This discharging oil flows into a reservoir 14 from which it is fed back into the lubricating-oil circulation system of the printing press. This particular arrangement illustrated by way of example not only permits a contact-free inflow of the temperature-controlled fluid into the the interior space 10 of the duct roller 2 and a contact-free outflow therefrom, respectively, but also, simultaneously ensures continuous temperature control or regulation of the oil in the vicinity of the duct roller 2, thereby increasing the consistency of the temperature of the duct roller.

I claim:

1. An inking unit of a printing press, comprising:

a frame;

at least one ink duct roller rotatably supported in said frame, said ink duct roller having an interior space formed therein, said ink duct roller having an axial bore extending into said interior space and defining bore surfaces;

a fixedly mounted pipe stub having an end extending through said axial bore and projecting into said interior space of said ink duct roller without contacting said bore surfaces defining an annular gap between said bore surfaces and said pipe stub;

lubricating oil reservoir; and said pipe stub being connected to said lubricating oil reservoir for emptying lubricating oil flowing through said pipe stub into said interior space of said ink duct roller and discharging the oil through said annular gap into said lubricating oil reservoir.

2. The inking unit according to claim 1, wherein said duct roller is the only roller associated with said lubricating oil reservoir.

3. The inking unit according to claim 2, wherein said duct roller has a bearing body in which said fixedly mounted pipe stub is mounted.

4. The inking unit according to claim 2, wherein said lubricating oil reservoir is temperature-controlled and stabilizes the temperature of said duct roller.

* * * * *